United States Patent [19]

Muntjanoff

[11] 4,201,510

[45] May 6, 1980

[54] AUTOMATIC GRAPPLE CONTROL SYSTEM

[75] Inventor: John R. Muntjanoff, Aurora, Ill.

[73] Assignee: Caterpillar Tractor Co., Peoria, Ill.

[21] Appl. No.: 900,632

[22] Filed: Apr. 27, 1978

[51] Int. Cl.[2] ..... B66C 3/16

[52] U.S. Cl. ..... 414/730; 60/420; 91/518; 294/88

[58] Field of Search ..... 214/147 G; 294/88; 60/420, 484; 91/512, 517, 518; 414/729, 730, 739

[56] References Cited

U.S. PATENT DOCUMENTS

| | | | |
|---|---|---|---|
| 3,631,989 | 1/1972 | McCormick | 214/147 G X |
| 3,854,766 | 12/1974 | Jordan | 294/88 |
| 3,865,424 | 2/1975 | Jabkowski | 294/88 |

FOREIGN PATENT DOCUMENTS

| | | | |
|---|---|---|---|
| 422653 | 9/1974 | U.S.S.R. | 214/147 G |
| 448999 | 11/1974 | U.S.S.R. | 214/147 G |
| 544609 | 2/1977 | U.S.S.R. | 214/147 G |

*Primary Examiner*—L. J. Paperner

*Attorney, Agent, or Firm*—William B. Heming

[57] ABSTRACT

A grapple tong system has first and second hydraulic lines for closing and raising the grapple tongs, respectively. A hydraulic system is provided for automatically, controllably passing fluid from the second to the first line in response to a preselected pressure in the first line and a higher pressure in the second line for automatically, controllably urging the grapples to a closed position.

8 Claims, 1 Drawing Figure

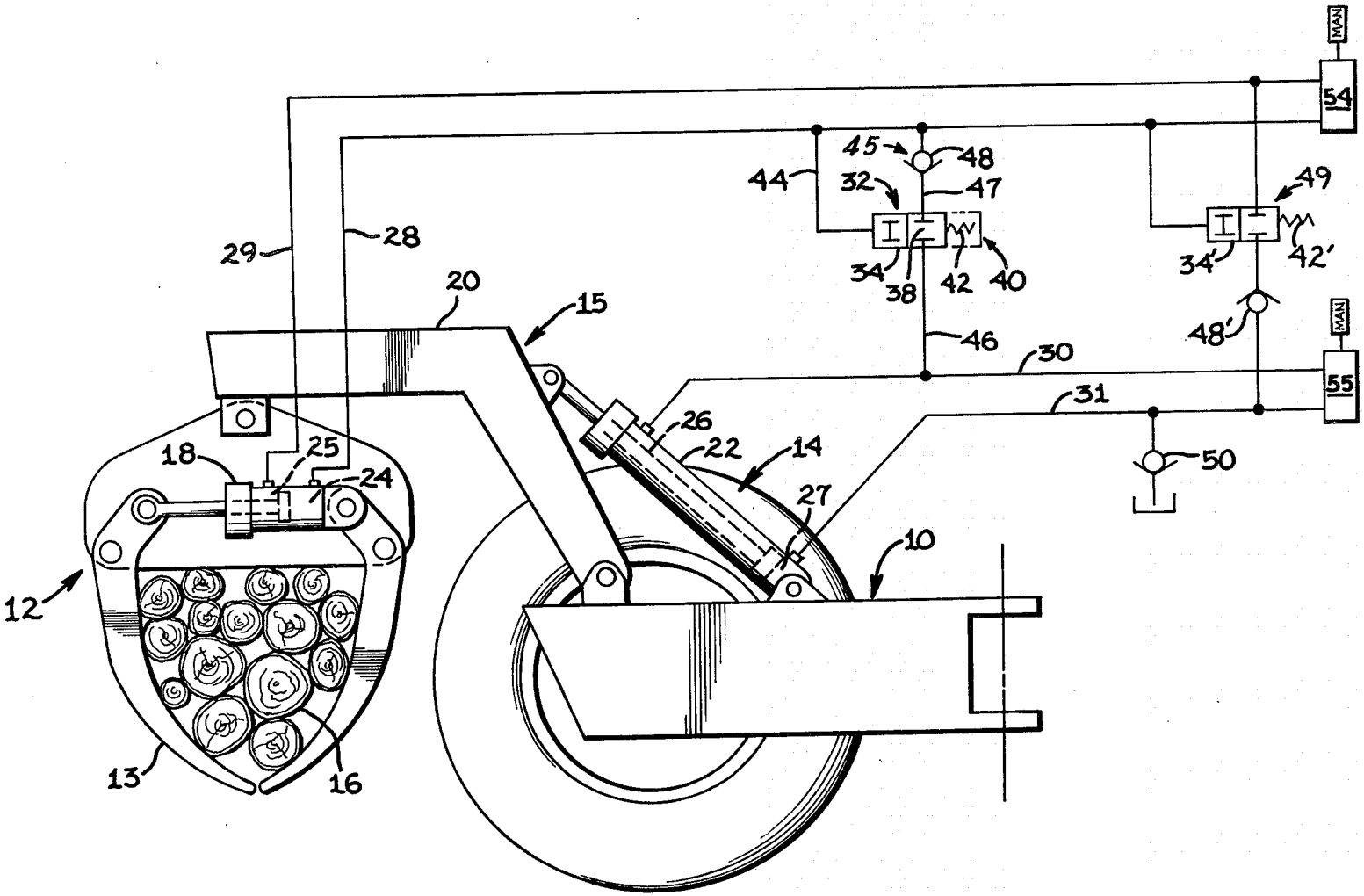
MAN
54
MAN
55
49
42'
34'
48'
50
31
30
40
48
47
42
46
45
32
34
38
44
10
14
27
22
26
15
20
28
24
25
16
29
18
13
12

AUTOMATIC GRAPPLE CONTROL SYSTEM

BACKGROUND OF THE INVENTION

In the use of grapple tongs, it is desirable that pressure be maintained in the hydraulic circuit controlling the closing of the tongs in order to prevent a load carried by the tongs from falling or slipping.

Grapple tong implements are used to grasp and transport loads. These loads sometimes become loose within the grapple, owing to reorientation of the load or leakage of hydraulic fluid from the grapple tong system.

A typical example is the transportation of several logs from a harvesting site to a loading station. This transportation is generally over uneven ground, the logs are of ununiform configuration, and the work vehicle is generally not constructed to isolate the load from impacts during transportation. Shifting of the logs or leakage of hydraulic grapple fluid can cause the logs to fall from the grapple. The resultantly required reloading of the logs in the grapple represents a waste of labor and time. It is, therefore, desirable to provide means for automatically and controllably maintaining the grapple in forcible engagement with the load during shifting of the load and/or hydraullic fluid leakage.

SUMMARY OF THE INVENTION

According to the present invention, means is provided for automatically, controllably passing fluid to a first hydraulic line from a second line in response to a preselected pressure in the first line and a higher pressure in the second line.

BRIEF DESCRIPTION OF THE DRAWING

The drawing is a diagrammatic view of the hydraulic circuit of this invention connected to a grapple of a log transporting vehicle.

DETAILED DESCRIPTION OF THE INVENTION

Referring to the drawing, a work vehicle 10 has first and second work systems 12, 14. In the example apparatus shown, the first work system 12 consists of grapple tongs 13 for holding and transporting logs 16 or other items, and the second work system 14 is an elevating system 15 for raising, lowering, and positioning the grapple 13.

Opening and closing of the grapple 13 is controlled by a double-acting hydraulic cylinder 18 and the elevating system 15 has a pivotally movable boom 20 that is connected to a double-acting hydraulic cylinder 22 for controlling movement of the grapple 13 to preselected positions.

Such first and second work systems 12, 14 and their controlling hydraulic cylinders 18, 22 are well known in the art.

As is further known in the art, the cylinders 18, 22 each experience the greatest force when the system is in a condition wherein the grapples are grasping a load and the load has been lifted off the ground. Therefore, the controlling hydraullic portions of each cylinder 18, 22 which will be subjected to the greater hydraulic fluid pressure are the first or closing chamber 24 of the grapple cylinder 18 and the first or raising chamber 26 of the boom cylinder 22. Each of these first chambers 24, 26 have respective hydraulic lines 28, 30 which are associated with a pressurized fluid source and controlling valve 54.

Each hydraullic cylinder 18, 22 also has a respective opening chamber 25 and lowering chamber 27. A hydraulic line 29 is connected at one end to the opening chamber 25 and at the other end to controlling valve 54. A hydraulic line 31 is connected at one end to the lowering chamber 27 and at the other end to controlling valve 55.

First means 32 is provided for automatically and controllably passing fluid from the second to the first hydraulic lines 30, 28 in response to a preselected pressure in said first line 28 and a pressure in said second line 30 that is greater than the pressure in said first line 28.

A first controlling valve 34 is connected to the first and second hydraulic lines 28, 30. The valve 34 is movable between a first position, shown by broken lines, at which the valve is open and fluid can pass from the second hydraulic line 30 to the first hydraulic line 28, and a second position (shown) at which the valve is closed. The valve 34 is continuously biased toward the second, or closed position and is movable toward the first or open position in response to pressure in the first hydraulic line 28. At a preselected pressure in line 28, the controlling valve 34 is in the first or open position.

As shown in the drawing, the continuous biasing means 40 can be a spring 42 urging the valve 34 toward the closed position. A pilot pressure line 44 is connected at one end to the first hydraulic line 28 and at the other end to the controlling valve 34. Pressure from the first hydraulic line 28 urges against a spool of the first controlling valve 34 in opposition to force in the spool by the spring 42. By varying the spring force, the controlling valve 34 can be altered to open at different preselected pressures. A suggested opening pressure is greater than about 100 psi. The controlling valve 34 and biasing means 40 are well known in the art.

Third means 45 for controlling the passage of fluid in a single direction from the second hydraulic line 30, through the first controlling valve 34 and to the first hydraulic line 28 is provided. The third means 45 can be a check valve 48 positioned in a line 46 extending between the second hydraulic line 30 and the controlling valve 34, positioned in line 47 extending between the first controlling valve 34 and the first hydraulic line 28 (shown) or the check valve 48 can be an integral part of the controlling valve 34. Preferably, the check valve 48 is positioned between the first controlling valve 34 and the first hydraulic line 28.

It is desirable to provide second means 49 for communicating the third and fourth hydraulic lines 29, 31. As shown in the drawing, second means 49 can be a second controlling valve 34' and check valve 48' which are substantially the same as the first controlling valve 34 and check valve 48. The valve 34' is movable between a first or open position and a second or closed position and is continuously biased toward the second or closed position (shown) by spring 42', and is movable toward the first or open position in response to pressure in the first hydraulic line 28. The check valve 48' controls the passage of fluid in a single direction from the third hydraulic line 29 to the fourth hydraulic line 31.

The second means 49 can be a portion of the controlling valves 54, 55, of the work vehicle 10. The first and second means 32, 49 can also be of other construction without departing from this invention. However, it is preferred that the first and second means 32, 49 be valves as shown in the drawing. Further, a make-up valve 50, as is shown in the art, can be connected to the fourth hydraulic line 31.

OPERATION

In the operation of the grapple tong system, the first and second hydraulic lines 28, 30 are in fluid communication when the first hydraulic line is at or above a preselected pressure and hydraulic fluid and/or pressure is free to pass from the second into the first line 30, 28. Therefore, the tendency of the grapple tongs 13 to loosen due to leakage in the hydraulic circuits or shifting of the load 16 is substantially overcome.

For example, when the grapple tongs are used for transporting logs 16, the first work system 12 is actuated for tightening the grapple tongs 13 about the logs 16. The resultant pressure in the first hydraulic line 28 passes through the pilot pressure line 44 and overcomes the spring 42 to shift the first controlling valve 34 from the closed position to the open position when the preselected pressure, as determined by the spring force of said spring 42, is reached in the first hydraulic line 28. With the load being securely held by the tongs, the second work system 14 is engaged to lift the load from the ground for transportation. Subsequent shifting of the logs within the grapple 13 or loss of hydralic fluid in the first work system 12 can cause a loosening of the tongs 13 and result in a pressure drop in the first hydraulic line 28. As the pressure drops, higher pressure in the second hydraulic line 30 is available to the grapple tongs 13 through the controlling valve 34 and check valve 48. The pressure thereafter equalizes in lines 28, 30 with a resultant tightening of the grapple tongs 13 and loss of the load is avoided.

As the grapple tongs 13 tighten, the resultant fluid flow in the third hydraulic line 29 from the opening chamber 18 exhausts to the fourth hydraulic line 31 through the second controlling valve 34' and the second check valve 48'. Any resultant demand for hydraulic fluid in lower chamber 27 caused by automatic tightening of the grapple tongs 13 is supplied from the fluid exhausting from the third hydraulic line 29 and/or make-up valve 50.

Other aspects, objects and advantages of this invention can be obtained from a study of the drawings, the disclosure and the appended claims.

The embodiment of the invention in which an exclusive property or privilege is claimed are defined as follows:

1. In a grapple tong system having first and second hydraulic lines for closing and raising the grapple tongs, respectively, and third and fourth hydraulic lines for opening and lowering the grapple tongs, respectively, the improvement comprising:

first means for automatically, controllably passing fluid from the second to the first hydraulic line in response to a first preselected pressure in said first hydraulic line and a second pressure in said second hydraulic line, said second pressure being greater than said first pressure, said first means including a first controlling valve connected to the first and second hydraulic lines and third means for controlling the passage of fluid in a single direction from the second hydraulic line, through the first controlling valve and to the first hydraulic line, said first controlling valve being movable between a first position at which said first valve is open and a second position at which said first valve is closed and being continuously biased toward its second position and movable toward its first position in response to pressure in the first hydraulic line; and second means for controllably communicating said third and fourth hydraulic lines, said second means including a second controlling valve connected to the third and fourth hydraulic lines and movable between a first position at which said second valve is open and a second position at which said second valve is closed, said second controlling valve being continuously biased toward its second position and movable toward its first position in response to pressure in said first hydraulic line.

2. In a grapple tong system, as set forth in claim 1, wherein the means for controlling the passage of fluid is a check valve.

3. In a grapple tong system, as set forth in claim 1, wherein the grapple tong system includes a double-acting grappling cylinder having a closing chamber and a double-acting lifting cylinder having a raising chamber, said first hydraulic line being connected to said grappling cylinder closing chamber and said second hydraulic line being connected to said lifting cylinder raising chamber.

4. In a grapple tong system, as set forth in claim 1, wherein the preselected pressure is greater than about 100 psi.

5. In a grapple tong system, as set forth in claim 1, wherein means for biasing said valve includes a spring and a pilot pressure line, said spring being positioned at a location sufficient for continuously biasing the controlling valve toward the second position, said pilot pressure line being connected to the first hydraulic line and the controlling valve and being positioned at a location sufficient for moving the controlling valve toward the first position in response to a preselected pressure in said first line.

6. In a grapple tong system, as set forth in claim 1, wherein the grapple tong system includes a double-acting grappling cylinder having closing and opening chambers and a double-acting lifting cylinder having raising and lowering chambers, said first and third hydraulic lines being connected to said grappling cylinder closing and opening chambers, respectively, and said second and fourth hydraulic lines being connected to said lifting cylinder raising and lowering chambers, respectively.

7. In a grapple tong system, as set forth in claim 1, wherein the second controlling valve is moved to the open position in response to a pressure in said first hydraulic line greater than about 100 psi.

8. In a grapple tong system having first and second hydraulic lines for closing and raising the grapple tongs, respectively, and third and fourth hydraulic lines for opening and lowering the grapple tongs, respectively, the improvement comprising:

first means for automatically, controllably passing fluid from the second to the first hydraulic line in response to a first preselected pressure in said first hydraulic line and a second pressure in said second line, said second pressure being greater than said first pressure, said first means including a first controlling valve connected to the first and second hydraulic lines and movable between a first position at which said valve is open and a second position at which said valve is closed, said first controlling valve being continuously biased toward the second position and movable toward the first position in response to pressure in said first hydraulic line;

means for biasing said first controlling valve, said biasing means including a spring and a pilot pressure line, said spring being positioned at a location sufficient for continuously biasing the first controlling valve toward its second position, said pilot pressure line being connected to the first hydraulic line and the first controlling valve and being positioned at a location sufficient for moving the first controlling valve toward its first position in response to a preselected pressure in said first hydraulic line;

second means for controllably communicating said third and fourth lines; and third means for controlling the passage of fluid in a single direction from the second hydraulic line, through the first controlling valve and to the first hydraulic line.

* * * * *